US006508222B2

(12) United States Patent
Takano

(10) Patent No.: US 6,508,222 B2
(45) Date of Patent: Jan. 21, 2003

(54) POWER TRANSMISSION DEVICE OF AN ENGINE

(75) Inventor: Kiyohito Takano, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 56 days.

(21) Appl. No.: 09/874,526

(22) Filed: Jun. 5, 2001

(65) Prior Publication Data

US 2001/0047787 A1 Dec. 6, 2001

(30) Foreign Application Priority Data

Jun. 6, 2000 (JP) ..... 2000-169021

(51) Int. Cl.[7] ..... F02F 7/00
(52) U.S. Cl. ..... 123/195 AC
(58) Field of Search ..... 123/198 DB, 195 AC; 180/292; 440/75, 76; 74/703

(56) References Cited

U.S. PATENT DOCUMENTS 5,014,812 A * 5/1991 Kazama ..... 123/195 AC
5,046,578 A * 9/1991 Nakayama et al. ... 123/195 AC
5,992,355 A * 11/1999 Shichinohe et al. .. 123/195 AC
6,305,342 B1 * 10/2001 Narita et al. ..... 123/195 AC

FOREIGN PATENT DOCUMENTS

JP 60237232 A 11/1985

* cited by examiner

*Primary Examiner*—Willis R. Wolfe
*Assistant Examiner*—Jason Benton
(74) *Attorney, Agent, or Firm*—Marshall, Gerstein & Borun

(57) ABSTRACT

A first bearing 16 rotatably supports a crank shaft 10 with respect to a crank case 6. A tubular portion 43 is formed integrally with the crank case 6. A drive shaft 20 penetrates through the tubular portion 43. A second bearing 21 is provided in the tubular portion 43. A center axis 10A of the crank shaft 10 is positioned between a vicinity of one end of the tubular portion 43 and a vicinity of the other end of the tubular portion 43 in an axial direction of the drive shaft 20. A center axis 20A of the drive shaft 20 is positioned between a vicinity of one end of the first bearing 16 and a vicinity of the other end of the first bearing 16 in an axial direction of the crank shaft 10.

3 Claims, 5 Drawing Sheets

POWER TRANSMISSION DEVICE OF AN ENGINE

BACKGROUND OF THE INVENTION

1. Field of the Invention

The present invention relates to a power transmission device of an engine and, more particularly to a power transmission device of an engine having a mechanism for converting a rotational direction of an output of the engine by substantially 90 degrees.

2. Description of the Related Art

There are various types of engines according to uses. For example, an engine includes a drive shaft extending in a direction orthogonal to a crank shaft of the engine. Such an engine is adopted as an engine of a shaft drive type motor cycle, an engine of a straddle-type four wheel all terrain vehicle, or the like.

FIG. 5 is a partially sectioned side view showing an engine 101 of a straddle-type four wheel all terrain vehicle disclosed in Japanese Laid-Open Patent Publication No. Sho. 60-237232. Referring to FIG. 5, in the engine 101, a drive shaft 120 is placed below a crank shaft 110. The drive shaft 120 extends such that it makes substantially 90 degrees with respect to the crank shaft 110. In a crank chamber 139, a wall portion 134 is formed rear of the crank shaft 110 but there is no wall portion formed below the crank shaft 110. The reason why no wall portion is formed below the crank shaft 110 is that the drive shaft 120 is placed close to the crank shaft 110. The drive shaft 120 is placed close to the crank shaft 110 to make the engine 101 small.

As describe above, to realize that the engine 101 in which the drive shaft 120 is placed below the crank shaft 110 and the drive shaft 120 makes substantially 90 degrees with respect to the crank shaft 110 is made small, it is desirable to place the drive shaft 120 as close to the crank shaft 110 as possible.

The crank shaft 110 is a member at which a rotational driving force is generated in the engine 101. The drive shaft 120 is a member from which the rotational driving force is output to outside of the engine 101. These shafts are members to be firmly supported by a crank case. In order to firmly support the crank shaft 110 and the drive shaft 120, it is necessary to form a chamber accommodating the crank shaft 110 and a chamber accommodating the drive shaft 120 such that these chambers have sufficient rigidity.

In order to ensure the rigidity of the chamber accommodating the drive shaft 120 and the rigidity of the chamber accommodating the crank shaft 110 and firmly support the drive shaft 120 and the crank shaft 110, it is desirable to form a separating wall integrated with the crank case between the drive shaft 120 and the crank shaft 110.

When forming the separating wall, it is necessary to position the separating wall so as to prevent a crank pin and a crank web of the crank shaft 110, a connecting rod and the like, from coming into contact with the separating wall when they are rotating. Therefore, when an attempt is made to place the drive shaft 120 just below the crank pin and to position the separating wall having sufficient rigidity so as to prevent the rotating crank pin or the rotating connecting rod from coming into contact with separating wall, it is necessary to place the drive shaft 120 considerably below the crank shaft 110. Such placement makes the engine 101 large.

SUMMARY OF THE INVENTION

The present invention has been developed for obviating the above-described problem, and an object of the present invention is to provide a power transmission device of an engine which makes the engine small and enables a crank shaft and a drive shaft to be supported by a sufficiently rigid crank case.

To solve the above-described problem, there is provided a power transmission device of an engine comprising; a crank shaft; a drive shaft provided such that the drivel shaft makes substantially 90 degrees with respect to the crank shaft, a rotational driving force from the crank shaft being transmitted to the drive shaft; a crank case; a first bearing for rotatably supporting the crank shaft with respect to the crank case; and a second bearing for rotatably supporting the drive shaft, wherein a tubular portion is formed integrally with the crank case and is provided with the second bearing in the tubular portion, the drive shaft penetrating through the tubular portion, a center axis of the crank shaft is positioned between a vicinity of one end of the tubular portion and a vicinity of the other end of the tubular portion in an axial direction of the drive shaft, and a center axis of the drive shaft is positioned between a vicinity of one end of the first bearing and a vicinity of the other end of the first bearing in an axial direction of the crank shaft. That is, the center axis of the crank shaft may be positioned in the vicinity of one end of the tubular portion, in the vicinity of the other end of the tubular portion, or between the opposite ends of the tubular portion in the axial direction of the drive shaft. Also, the center axis of the drive shaft may be positioned in the vicinity of one end of the first bearing, in the vicinity of the other end of the first bearing, or between the opposite ends of the first bearing in the axial direction of the crank shaft.

According to a structure described above, the drive shaft can be placed close to the crank shaft so that a crank pin, a crank web, and a connecting rod do not come into contact with the drive shaft when they are rotating. Consequently, the engine can be made small. In addition, the rigidity of the tubular portion can lessen relative displacement between the drive shaft from which the rotational driving force is output and the crank shaft at which the rotational driving force is generated. Accordingly, the drive shaft and the crank shaft can be firmly supported.

In the power transmission device of an engine, a mounting portion may be formed integrally with the crank case for securing the crank case to a vehicle body frame of a vehicle, and the tubular portion may be positioned between the crank shaft and the mounting portion. According to a structure described above, strength of the portion supporting the crank shaft or strength of the mounting portion is ensured by the rigidity of the tubular portion. Accordingly, the crank shaft, and the drive shaft can be firmly supported by the vehicle body frame.

It is preferable that in the power transmission device of an engine, a part of a fitting portion for fitting the first bearing forms a side wall portion of a crank chamber, and the side wall portion, a peripheral wall portion surrounding an outer periphery of the crank shaft, and the mounting portion are integrally connected through the tubular portion.

These objects, as well as other objects, features and advantages of the invention will become more apparent to those skilled in the art from the following description with reference to the accompanying drawings.

DETAILED DESCRIPTION OF THE PREFERRED EMBODIMENT

Hereinafter, an embodiment of the present invention will be described with reference to accompanying drawings.

Figure 1:
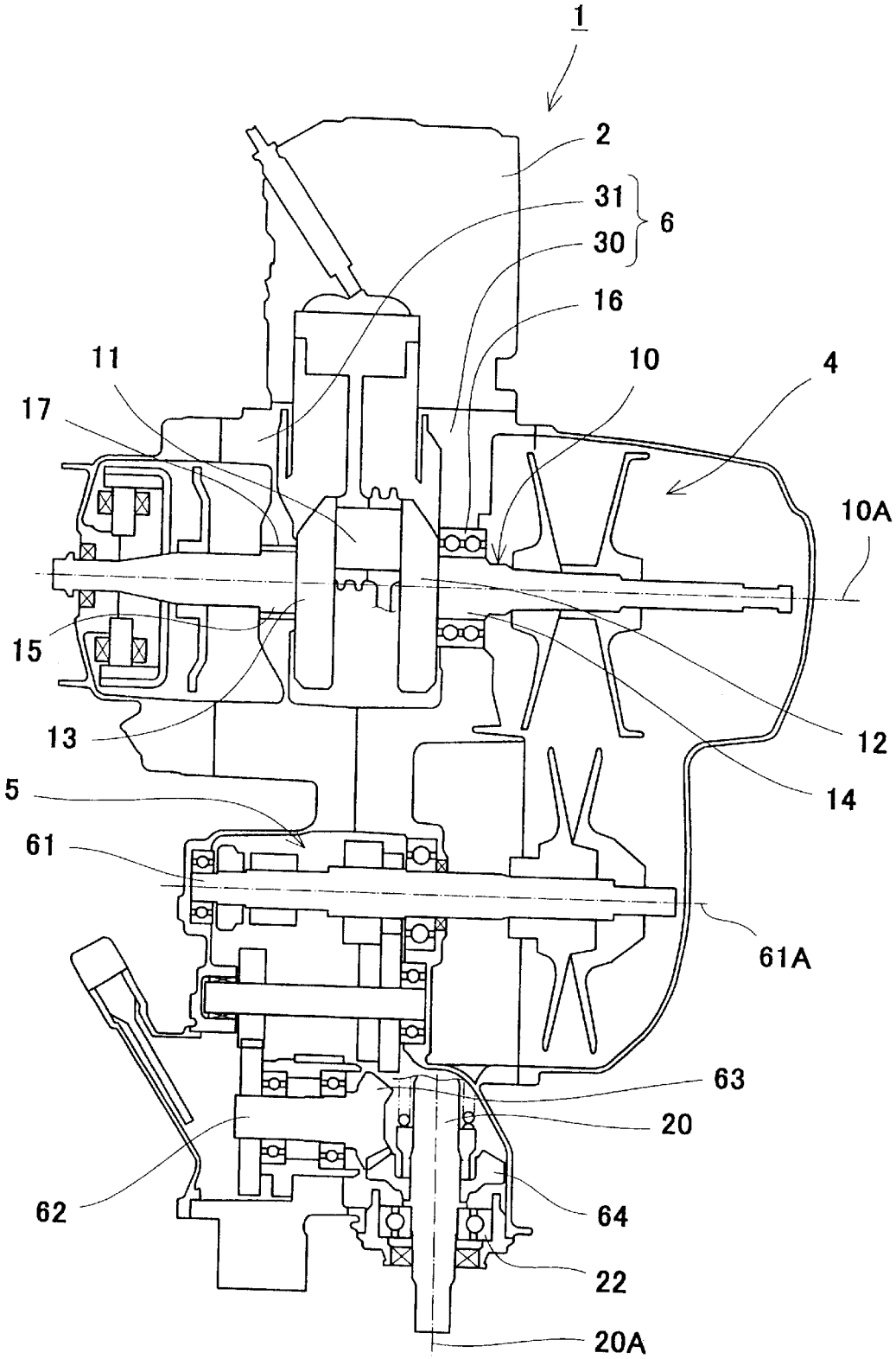
FIG. 1 is a view showing a structure of an engine which employs a power transmission device of the engine according to an embodiment of the present invention.

FIG. 1 is a view showing a structure of an engine 1 to be applied to a vehicle such as a straddle-type four wheel all terrain vehicle. The straddle-type four wheel all terrain vehicle travels on sandy soil, rough terrain, rocky hills, and terrain with puddles of muddy water or the like. The straddle-type four wheel all terrain vehicle is also referred to as ATV for short. A power transmission device of an engine according to the embodiment of the present invention is adopted in the engine 1 of FIG. 1.

Referring now to FIG. 1, the engine 1 is a V-type two cylinder engine including two cylinders 2, 3 (see FIG. 2), although the cylinder 2 is shown in FIG. 1. The engine 1 comprises a crank shaft 10, a belt-type automatic transmission unit (belt converter) 4, a gear-type transmission unit 5, and a drive shaft 20 provided such that the drive shaft 20 makes substantially 90 degrees with respect to the crank shaft 10. As can be seen from FIG. 1, the crank shaft 10 serves as an input shaft of the belt converter 4 and an input shaft 61 of the gear-type transmission unit 5 serves as an output shaft of the belt converter 4. The rotational driving force of the crank shaft 10 is transmitted to an output shaft 62 of the gear-type transmission unit 5 through the belt converter 4 and the gear-type transmission unit 5. The output shaft 62 is provided with a driving bevel gear 63. The driving bevel gear 63 is in mesh with a driven bevel gear 64 mounted on the drive shaft 20. Therefore, a direction of the rotational driving force of the output shaft 62 is converted by substantially 90 degrees and the resulting force is transmitted to the drive shaft 20. A propeller shaft (not shown) is connected to the drive shaft 20, and through the propeller shaft, wheels of the vehicle are driven.

The crank shaft 10 comprises a crank pin portion 11, two crank web portions 12, 13, and two main shaft portions 14, 15. The crank web portions 12, 13 are provided on opposite end portions of the crank pin portion 11. The main shaft portions 14, 15 are respectively provided outwardly of the crank web portions 12, 13. The main shaft portion 14 is rotatably supported by the crank case 6 by means of a ball bearing 16 corresponding to a first bearing and the main shaft portion 15 is rotatably supported by the crank case 6 by means of a plain bearing 17.

Figure 2:
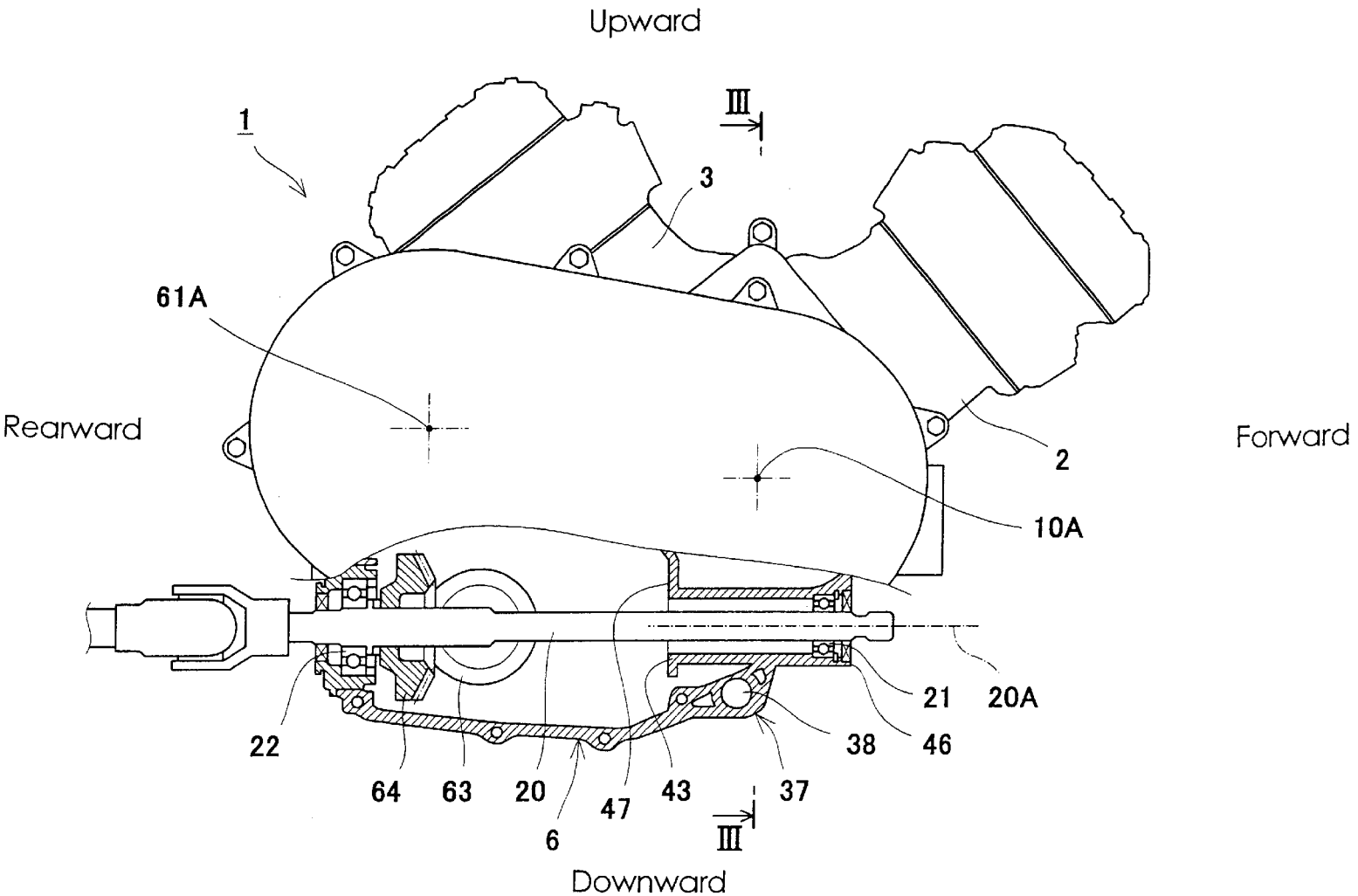
FIG. 2 is a partially sectioned side view showing the engine of FIG. 1.
Figure 3:
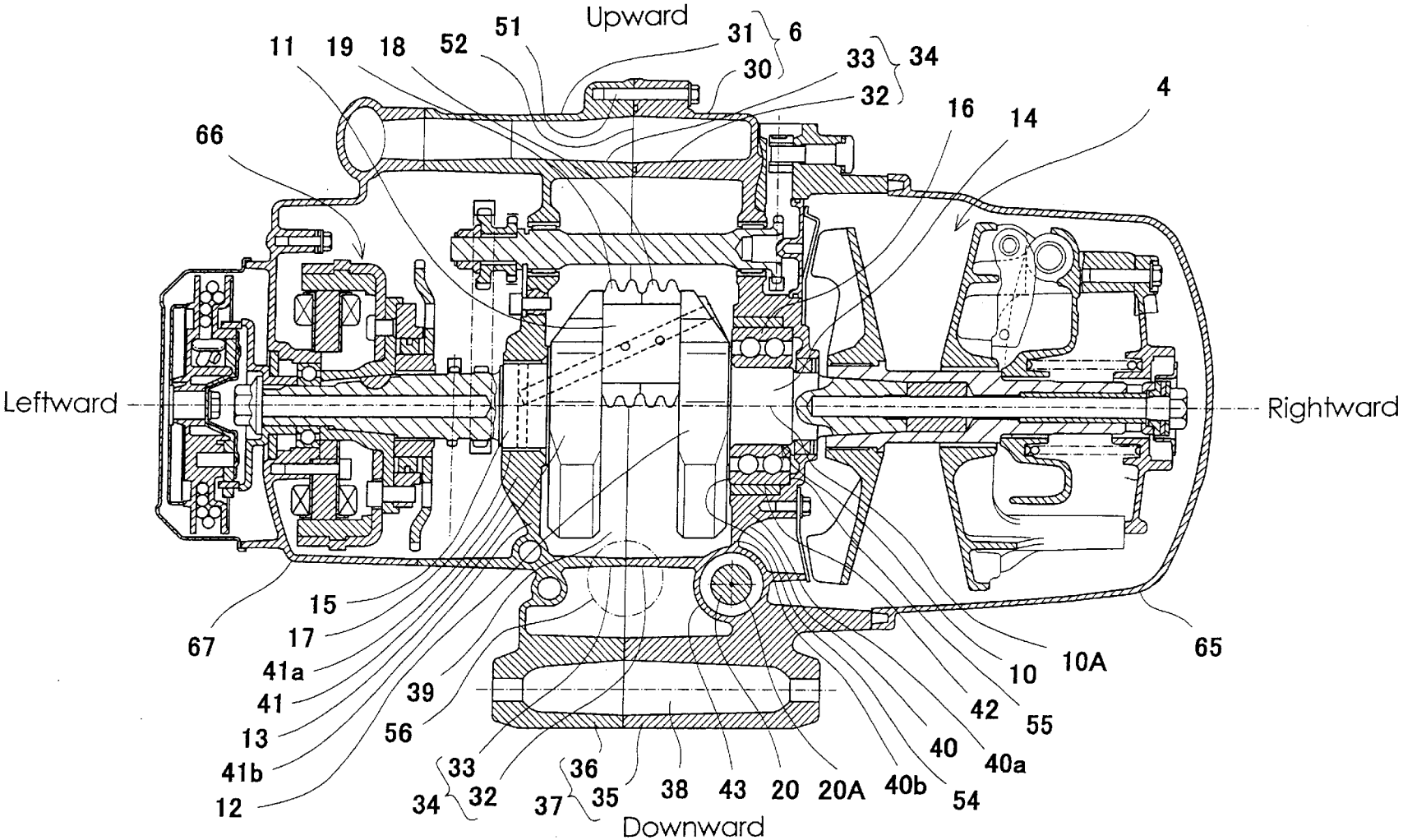
FIG. 3 is a cross-sectional view taken in the direction of the arrows substantially along line III—III of FIG. 2.

FIG. 2 is a partially sectioned side view showing the engine 1 and FIG. 3 is a cross-sectional view taken in the direction of the arrows substantially along line III—III of FIG. 2.

In FIG. 2, reference numeral 10A denotes a position of a center axis of the crank shaft 10, i.e., a position of a center axis of the input shaft of the belt converter 4 and reference numeral 61A denotes a position of a center axis of the input shaft 61 of the gear-type transmission unit 5, i.e., a position of a center axis of the output shaft of the belt converter 4. As described above, the driven bevel gear 64 mounted on the drive shaft 20 is in mesh with the driving bevel gear 63 of the output shaft 62 of the gear-type transmission unit 5. Thereby, the rotational driving force of the crank shaft 10 is transmitted to the drive shaft 20. The crank shaft 10 is a portion at which the rotational driving force is generated in the engine 1 and the drive shaft 20 is a portion from which the rotational driving force is output to outside of the engine 1. For this reason, the crank shaft 10 and the drive shaft 20 need to be firmly supported by the crank case 6. As mentioned previously, the crank shaft 10 is supported by the crank case 6 by means of the two bearings 16, 17. The drive shaft 20 is rotatably sup ported by the crank case 6 such that a vicinity of a front end thereof is supported by means of the ball bearing 21 corresponding to the second bearing and a vicinity of a rear end thereof is supported by the ball bearing 22.

A tubular portion 43 is formed in the crank case 6. The tubular portion 43 is formed below the crank shaft 10. A front portion of the drive shaft 20 penetrates through the tubular portion 43. The ball bearing 21 is provided in the tubular portion 43 such that it is close to a front end 46 of the tubular portion 43. The drive shaft 20 is supported by the ball bearing 21 in the tubular portion 43. The center axis 10A of the crank shaft 10 is positioned between the front end 46 and a rear end 47 of the tubular portion 43 in the direction of the center axis 20A of the drive shaft 20.

Referring to FIG. 3, the tubular portion 43 is cylindrical. A crank chamber 39 is formed in the crank case 6. A peripheral wall portion 34 of the crank chamber 39 is formed such that it surrounds the crank pin portion 11 and the crank web portions 12, 13 in a circumferential direction of the center axis 10A of the crank shaft 10. The tubular portion 43 is placed adjacently to the crank chamber 39. The tubular portion 43 is placed below the ball bearing 16. A mounting portion 37 is formed below the tubular portion 43. The mounting portion 37 serves to secure the crank case 6 to a vehicle body frame (not shown) of the vehicle (straddle-type four wheel all terrain vehicle). Specifically, a hole portion 38 is formed in the mounting portion 37 to allow a bolt to penetrate therethrough. The mounting portion 37 is secured to the vehicle body frame by means of the bolt.

The crank case 6 is constituted by a right-side member 30 and a left-side member 31 which are coupled by means of a plurality of bolts 51. The crank case 6 is thus divided in two into a right-side part and a left-side part. A division face 52 between these parts vertically traverses the crank chamber 39 or the hole portion, 38. The peripheral wall portion 34 of the crank chamber 39 is constituted by a right-side portion 32 formed in the right-side member 30 and a left-side portion 33 formed in the left-side member 31. The mounting portion 37 is constituted by a right-side portion 35 formed in the right-side member 30 and a left-side portion 36 formed in the left-side member 31.

The right-side member 30 is provided with a fitting portion 40 for supporting the right-side main shaft portion 14 of the crank shaft 10. The fitting portion 40 includes a boss portion 40*a* and a side wall portion 40*b*. The side wall portion 40*b* forms a side wall of the crank chamber 39. A hole portion 42 is formed at a central portion of the boss portion 40*a*. The ball bearing 16 is fitted into hole portion 42.

The left-side members 31 is provided with a support portion 41 for supporting the left-side main shaft portion 15 of the crank shaft 10. The support portion 41 includes a boss portion 41*a* and a side wall portion 41*b*. The side wall portion 41*b* forms the side wall of the crank chamber 39. The plain bearing 17 is fitted in the boss portion 41*a*.

The fitting portion 401, the right-side portion 32 of the peripheral wall portion 34 of the crank chamber 39, the tubular portion 43, and the right-side portion 35 of the mounting portion 37 are integrally formed as a part of the right-side member 30 of the crank case 6. A part of the tubular portion 43 corresponds to a part of the right-side portion 32 of the peripheral wall portion 34 of the crank chamber 39.

The support portion 41, the left-side portion 33 of the peripheral wall portion 34 of the crank chamber 39, and the left-side portion 36 of the mounting portion 37 are integrally formed as a part of the left-side member 31 of the crank case 6. More specifically, the side-wall portion 40*b* of the crank chamber 39, the right-side portion 32 of the peripheral wall portion 34 and the right-side portion 35 of the mounting portion 37 are integrally formed via the tubular portion 43.

A cover member 65 is attached to a portion on the right side of the right-side member 30 of the crank case 6 such that it covers the belt converter 4 and the like. A cover member 67 is attached to a portion on the left side of the left-side member 31 of the crank case 6 such that it covers a generator 66 and the like.

Figure 4:
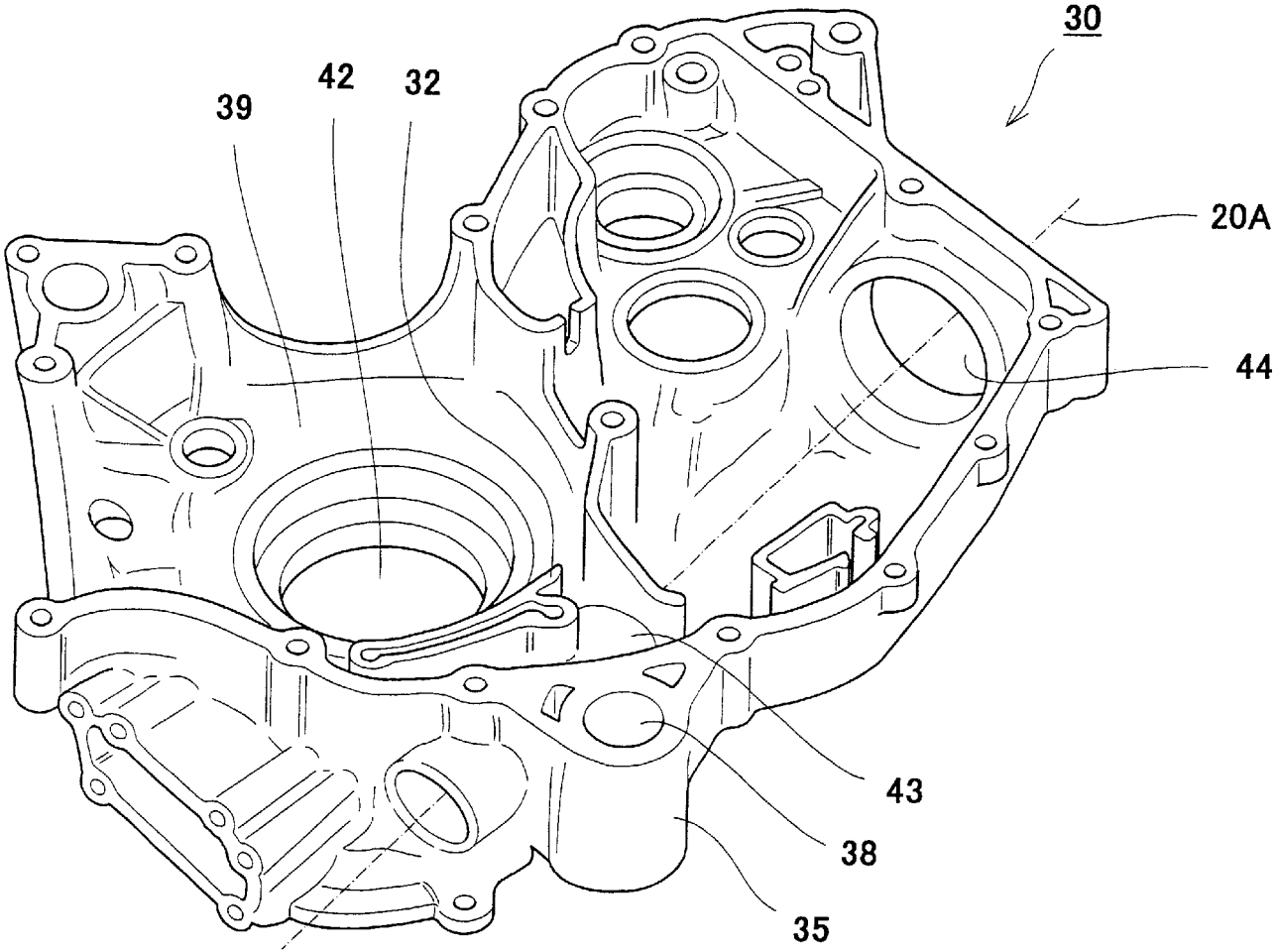
FIG. 4 is a perspective view showing a right-side member of a crank case.
Figure 5:
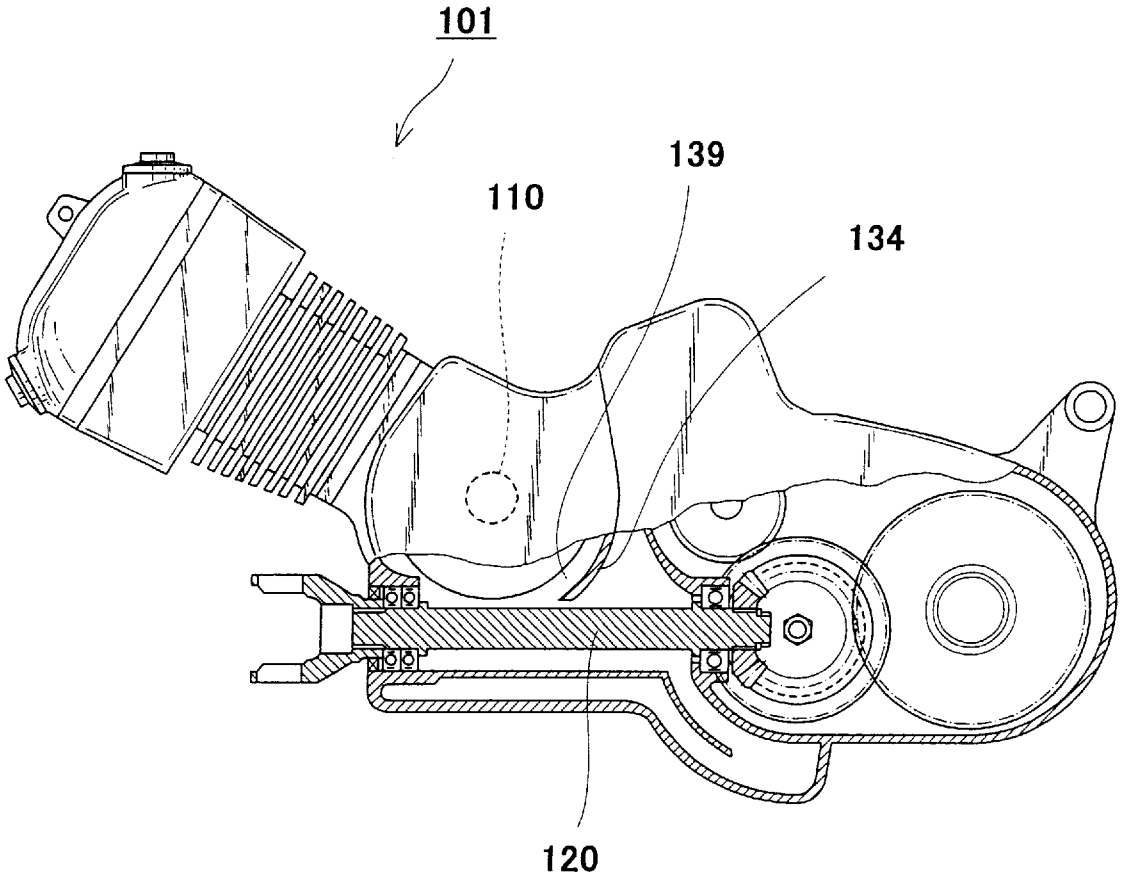
PRIOR ART Fig.5
FIG. 5 is a partially sectioned side view showing an engine which employs the conventional power transmission device of an engine.

FIG. 4 is a perspective view showing the right-side member 30 of the crank case 6. The hole portion 42 is a portion into which the ball bearing 16 is fitted for supporting the crank shaft 10. The hole portion 44 is a portion into which the ball bearing 22 is fitted for supporting the drive shaft 20. A dashed line passing through the tubular portion 43 and the hole portion 44 corresponds with the center axis 20A of the drive shaft 20.

Referring to FIG. 3 again, the center axis 20A of the drive shaft 20 is positioned such that it corresponds with a right end of the crank chamber 39 (on the belt converter's side) in position in the direction of the center axis 10A of the crank shaft 10 and it substantially corresponds with a left-end face 54 of the ball bearing 16 in position in the direction of the center axis 10A of the crank shaft 10. The tubular portion 43 is formed such that it surrounds the drive shaft 20 in the circumferential direction thereof. The center axis of the tubular portion 43 corresponds with the center axis 20A of the drive shaft 20.

The tubular portion 43 is provided between the fitting portion 40 and the mounting portion 37. In other words, the tubular portion 43 is positioned between the crank shaft 10 and the mounting portion 37. As described above, the ball bearing 16 is fitted in the fitting portion 40 for supporting the crank shaft 10 with respect to the crank case 6 and the ball bearing 21 is fitted in the tubular portion 43 for supporting the drive shaft 20. The mounting portion 37 serves to secure the crank case 6 to the vehicle body frame of the vehicle. The tubular portion 43, the fitting portion 40, and the mounting portion 37 are respectively subjected to large load. Since these portions are integrally formed, they reinforce one another.

The tubular portion 43 has high rigidity in structure due to its shape. A lower end portion of the fitting portion 40 is continuous with the tubular portion 43 having high rigidity. For this reason, the fitting portion 40 is reinforced by the rigidity of the tubular portion 43 and is less likely to be deformed. Since the fitting portion 40 and the tubular portion 43 prevent each other from being deformed, the center axis 10A of the crank shaft 10 is less likely to be displaced with respect to the center axis 20A of the drive shaft 20. The rotational driving force of the engine 1 is transmitted from the crank shaft 10 to the drive shaft 20 through various mechanisms. Because the center axis 10A of the crank shaft 10 is less likely to be displaced with respect to the center axis 20A of the drive shaft 20, transmission of the driving force can be stabilized.

In addition, since the mounting portion 37 is also continuous with the tubular portion 43, the mounting portion 37 is reinforced by the rigidity of the tubular portion 43 and is less likely to be deformed. Further, the fitting portion 40 and the mounting portion 37 are connected through the tubular portion 43, the fitting portion 40 as well as the tubular portion 43 is less likely to be displaced with respect to the mounting portion 37. That is, the tubular portion 43 and the fitting portion 40 are less likely to be displaced with respect to the vehicle body frame, and consequently, the crank shaft 10 and the drive shaft 20 are firmly supported by the vehicle body frame.

In this embodiment, the center axis 20A of the drive shaft 20 substantially corresponds with the left-end face 54 of the ball bearing 16 in position in the direction of the center axis 10A of the crank shaft 10. Therefore, the separating wall (tubular portion 43) can be positioned so as to prevent it from coming very close to or coming into contact with the crank shaft 10 if the drive shaft 20 is positioned closer to the crank shaft 10. By positioning the drive shaft 20 closer to the crank shaft 10, the engine 1 can be made small. Besides, since the portion (fitting portion 40) supporting the crank shaft 10 and the portion (tubular portion 43) supporting the drive shaft 20 are close to each other, these shafts can be more firmly supported.

A circle 56 represented by a two-dot chain line in FIG. 3 is an imaginary outline represented when the tubular portion 43 is moved to the left in FIG. 3. If the tubular portion 43 is horizontally moved to a point just below the crank pin portion 11 in FIG. 3, then a top portion of the tubular portion 43 comes very close to or comes into contact with the connecting rods 18, 19 when these rods are rotating.

Thus far, one embodiment of the present invention has been described.

While in this embodiment, the center axis 20A of the drive shaft 20 is positioned such that it substantially corresponds with the left-end face 54 (inner end face) of the ball bearing 16 in position in the direction of the center axis 10A of the crank shaft 10, the positioning of the center axis 20A is not limited to this. The center axis 20A of the drive shaft 20 may be positioned between the left-end face 54 and a right-end face 55 of the ball bearing 16 in the direction of the center axis 10A of the crank shaft 10, or may substantially correspond with the right end, face 55 in position in the direction of the center axis 10A.

Further, while in this embodiment, the center axis 10A of the crank shaft 10 is positioned between the opposite ends 46, 47 of the tubular portion 43 in the direction of the center axis 20A of the drive shaft 20, the positioning of the center axis 10A is not limited to this. The center axis 10A of the crank shaft 10 may substantially corresponds with one of the opposite ends of the tubular portion 43 in position in the direction of the center axis 20A.

Even when the center as 20A and the center axis 10A are thus positioned, the separating wall (tubular portion) can be formed as being positioned so as to prevent it from coming very close to or coming into contact with the crank shaft, although the drive shaft is close to the crank shaft.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A power transmission device of an engine comprising:

a crank shaft;

a drive shaft provided such that the drive shaft makes substantially 90 degrees with respect to the crank shaft, a rotational driving force from the crank shaft being transmitted to the drive shaft;

a crank case;

a first bearing for rotatably supporting the crank shaft with respect to the crank case; and a second bearing for rotatably supporting the drive shaft, wherein a tubular portion is formed integrally with the crank case and is provided with the second bearing in the tubular portion, the drive shaft penetrating through the tubular portion, a center axis of the crank shaft is positioned between a vicinity of one end of the tubular portion and a vicinity of the other end of the tubular portion in an axial direction of the drive shaft, and a center axis of the drive shaft is positioned between a vicinity of one end of the first bearing and a vicinity of the other end of the first bearing in an axial direction of the crank shaft.

2. The power transmission device of an engine according to claim 1, wherein a mounting portion is formed integrally with the crank case for securing the crank case to a vehicle body frame of a vehicle, and the tubular portion is positioned between the crank shaft and the mounting portion.

3. The power transmission device of an engine according to claim 2, wherein a part of a fitting portion for fitting the first bearing forms a side wall portion of a crank chamber, and the side wall portion, a peripheral wall portion surrounding an outer periphery of the crank shaft, and the mounting portion are integrally connected through the tubular portion.

* * * * *